US005898954A

United States Patent [19]

Provenzano

[11] Patent Number: 5,898,954

[45] Date of Patent: May 4, 1999

[54] TOILET INSTALLATION KIT

[75] Inventor: Joseph Provenzano, 11-58 Jackson Ave., Scarsdale, N.Y. 10583

[73] Assignee: Joseph Provenzano, Bronx, N.Y.

[21] Appl. No.: 09/071,909

[22] Filed: May 4, 1998

[51] Int. Cl.[6] ..... E03D 11/00

[52] U.S. Cl. ..... 4/252.1; 4/252.4; 4/252.5

[58] Field of Search ..... 4/252.1, 252.4, 4/252.5, 252.6, 253, 300, 420

[56] References Cited

U.S. PATENT DOCUMENTS

| | | | |
|---|---|---|---|
| 3,821,820 | 7/1974 | Thompson . | |
| 3,896,510 | 7/1975 | O'Connell . | |
| 4,504,983 | 3/1985 | Goodyer . | |
| 4,530,629 | 7/1985 | Sakow . | |
| 4,940,113 | 7/1990 | L'Heureux . | |
| 5,246,255 | 9/1993 | Forbes et al. | 4/252.1 |
| 5,421,036 | 6/1995 | Stevens et al. | 4/252.1 |
| 5,432,957 | 7/1995 | Fernie et al. | 4/252.1 |
| 5,608,922 | 3/1997 | Lewis . | |

*Primary Examiner*—David J. Walczak
*Attorney, Agent, or Firm*—Dilworth & Barrese

[57] ABSTRACT

A toilet installation kit and method of using thereof, containing pre-measured and disposable toilet installation components. The toilet installation kit includes a gasket for sealingly engaging a toilet to a closet flange and a connecting assembly including at least one flange bolt and corresponding washer and nut or nut caps for fastening the toilet to the closet flange. The toilet installation components include a predetermined measure of aggregate to be mixed with a corresponding measure of solution to form a settling compound for stabilizing the toilet to a floor surface. The components also include a tray having an interior for combining the pre-determined measure of aggregate and corresponding measure of solution therein, wherein the tray includes indicia indicating the corresponding measure of solution to be combined with the aggregate. Also included is a mixing or spreading instrument used for agitating the aggregate and solution to form the settling compound within the interior of the tray and for applying the settling compound to the floor surface.

19 Claims, 3 Drawing Sheets

TOILET INSTALLATION KIT

BACKGROUND

1. Technical Field

The present disclosure relates generally to the field of toilet or water closet installation, and more particularly, is directed to a toilet installation kit containing pre-measured and disposable components required in the installation of a toilet.

2. Background of Related Art

The installation of a floor-type toilet or water closet involves the use of several well known essential components including a sealing gasket and bolt assemblies which are used to sealingly engage a toilet to a corresponding closet flange and soil pipe. The installed toilet must be securely mounted to the floor to avoid any rocking or settling of the toilet with respect to the closet flange or floor. Otherwise, any rocking or settling of the toilet may eventually lead to possible leakage of waste material to the surrounding floor area. Accordingly, the installation of a toilet includes steps in preventing the rocking or settling of the toilet with respect to the floor. The primary manner in achieving rigid securement of an installed toilet is achieved through the use of a water resistant, rigid settling compound applied on the floor surface along the outer perimeter of the closet flange. These settling compounds are preferably applied to the toilet connection area in moldable form and subsequently cure to a rigid hardness. The application of settling compound during a toilet installation adds both time and labor to the total installation process. Application of settling compound includes the proper measurement and mixing of both aggregate and solution to form the settling compound within a container, application of the compound to the floor surface with the aid of a tool and finally, cleansing of the container and tools used in the application process.

In this respect, the toilet installation kit according to the present disclosure substantially departs from conventional concepts and techniques of the prior art, and in doing so provides an installation kit which is particularly well suited in solving the inadequacies involved in the installation of toilets according to the prior art. Therefore, it can be appreciated that there exists a need for a toilet installation kit containing pre-measured and disposable essential components required in installing a toilet.

The embodiments herein disclosed throughout the present disclosure achieve the intended purposes, objects, and advantages through a new, useful and unobvious combination of component elements, with the use of a minimum number of functioning parts, at a reasonable cost to manufacture, and by employing readily available materials.

SUMMARY

The present disclosure is directed to a toilet installation kit containing pre-measured and disposable toilet installation components. The toilet installation kit includes a gasket for sealingly engaging a toilet to a closet flange and a connecting assembly including at least one flange bolt and corresponding washer and nut or nut caps for fastening the toilet to the closet flange. The toilet installation components include a predetermined measure of aggregate to be mixed with a corresponding measure of solution to form a settling compound for stabilizing the toilet to a floor surface. The components also include a tray having an interior for combining the pre-determined measure of aggregate and corresponding measure of solution therein, wherein the tray includes indicia indicating the corresponding measure of solution to be combined with the aggregate. The tray may also be sized to accommodate the components of the toilet installation kit namely the gasket, connecting assembly, aggregate and spreading instrument. Also included is a mixing or spreading instrument, preferably a trowel or spatula, used for agitating the aggregate and solution to form the settling compound within the interior of the tray and for applying the settling compound to the floor surface. The solution may be comprised of water and the aggregate may be plaster, grout, mortar or cement.

The present disclosure is also directed to a method of installing a toilet using a toilet installation kit. The method involves a step of providing a toilet installation kit having a gasket for sealingly engaging a toilet and a closet flange, a connecting assembly for fastening the toilet to the closet flange, a predetermined measure of aggregate to be mixed with a solution to form a settling compound for stabilizing the toilet to a floor surface, a tray having an interior for combining the aggregate and solution therein, and a spreading instrument for applying the settling compound to the floor surface. Additional steps disclosed with the present method include: installing the connecting assembly to the closet flange, positioning the gasket along the closet flange, applying the settling compound to the floor surface along an outer perimeter of the closet flange and positioning the toilet onto the closet flange in alignment with the gasket and connecting assembly.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages may best be understood by reference to the following description, taken in connection with the accompanying drawings, in which:

DETAILED DESCRIPTION OF PREFERRED EMBODIMENTS

Figure 1:
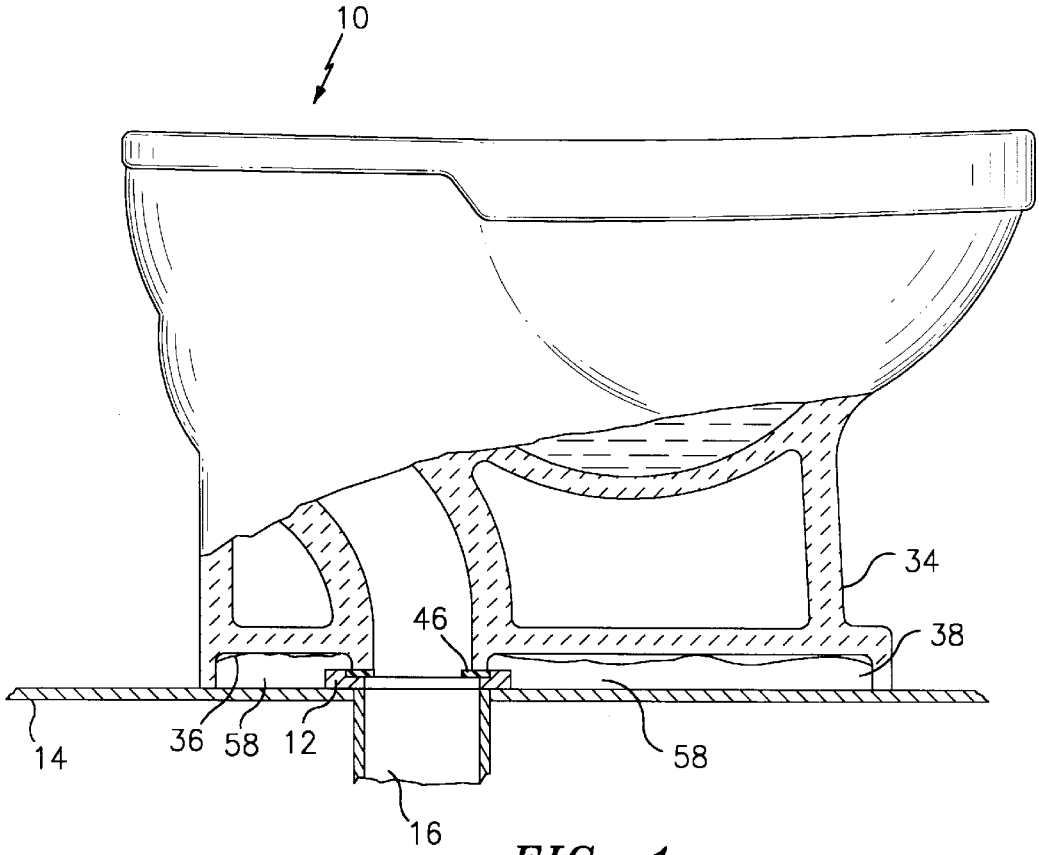
FIG. 1 is a perspective view with partial cross section of a horn portion of an installed toilet illustrating the several components employed with the toilet installation kit of the present disclosure.

Reference will now be made in detail to the preferred embodiments of the present disclosure, which are illustrated in the accompanying figures. Turning now to the figures, wherein like components are designated by like reference numerals throughout the various figures, attention is first directed to FIGS. 1 and 2.

Figure 5:
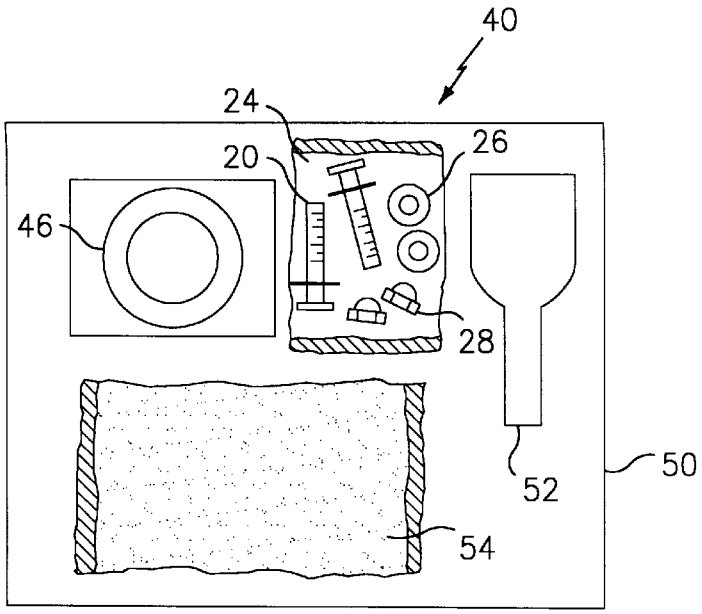
FIG. 5 is an illustrative perspective view of the toilet installation kit of the present disclosure.

A floor mounted toilet or water closet 10 is shown mounted to a closet flange 12 which is substantially flush with a floor surface 14. As is conventionally known, the closet flange 12 is coupled to soil or waste pipe 16 which leads to a sewer or septic waste collection system. A sealing gasket 46 is positioned along an inner annular periphery 48 of closet flange 12 to maintain a fluid seal between toilet outlet 42, closet flange 12 and soil pipe 16. As is best shown in FIGS. 3 and 5, connecting assembly 24 includes flange bolts 20, washers 26 and corresponding nuts or nut caps 28 which are used to fixedly attach horn portion 34 of toilet 10 to closet flange 12 through toilet bores 32 formed through horn portion 34.

Figure 2:
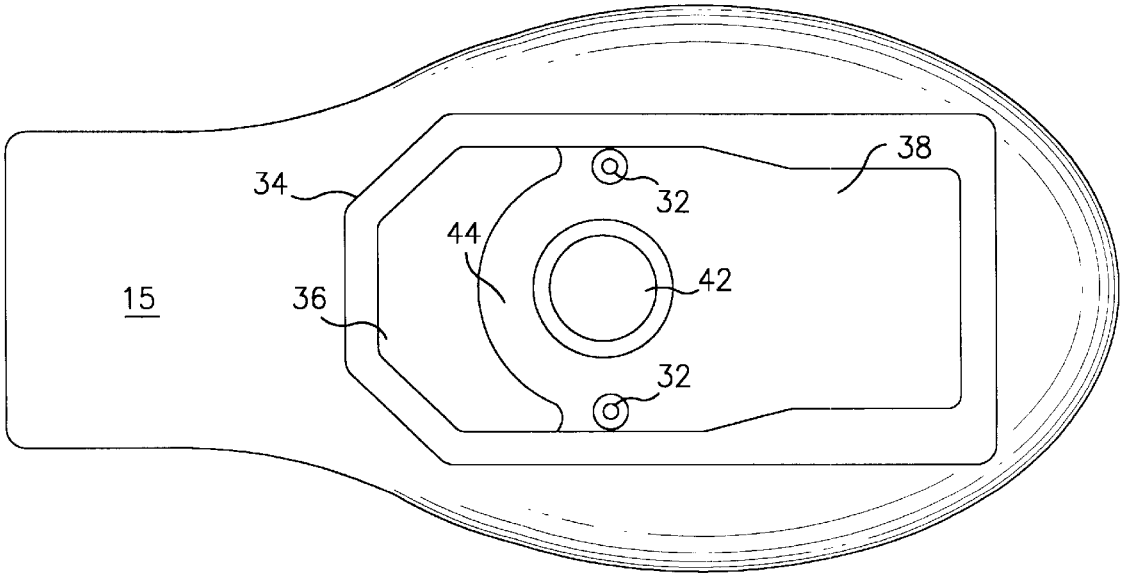
FIG. 2 is a bottom plan view of the horn portion of the toilet bowl of FIG. 1.

Now referring to FIG. 2, a bottom end 15 of toilet 10 is shown including a horn portion 34 having bores 32 for receiving flange bolts 20. Horn portion 34 includes toilet outlet 42 which fits over closet flange 12 and leads out into waste pipe 16. Toilet outlet 42 is surrounded by an outer annular area 44 which receives sealing gasket 46 when toilet 10 is seated onto closet flange 12. Correspondingly, closet flange 12 includes an inner annular periphery 48 for receiving sealing gasket 46. Horn portion 34 also includes a rear recessed area 36 and a front recessed area 38 which are generally situated outside outer annular area 44 and within the outer perimeter of horn portion 34. As will be described below, recess areas 36 and 38 generally accommodate settling compound 58 which is applied during toilet installations for stabilization of toilet 10 with respect to the floor surface 14.

Figure 3:
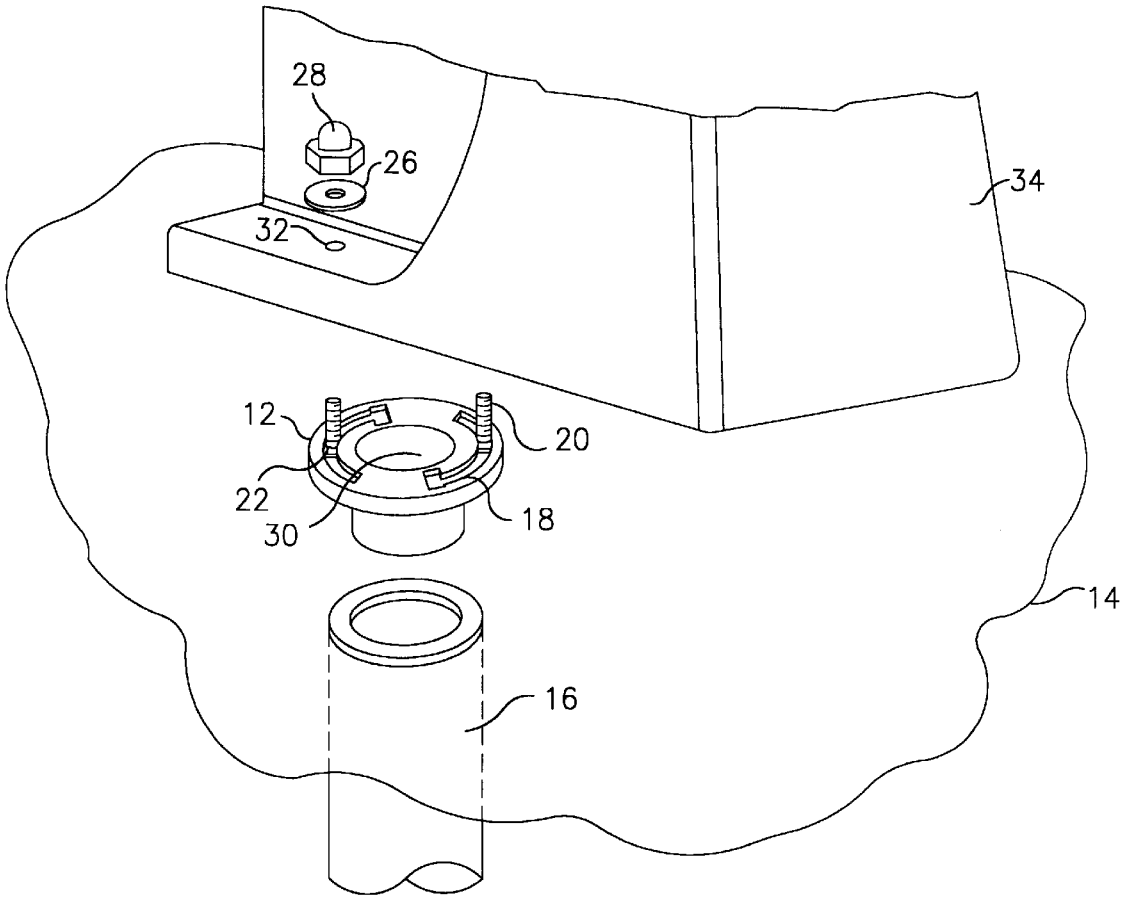
FIG. 3 is an exploded view of the toilet bowl of FIG. 1 illustrating the several components employed with the toilet installation kit of the present disclosure.
Figure 4:
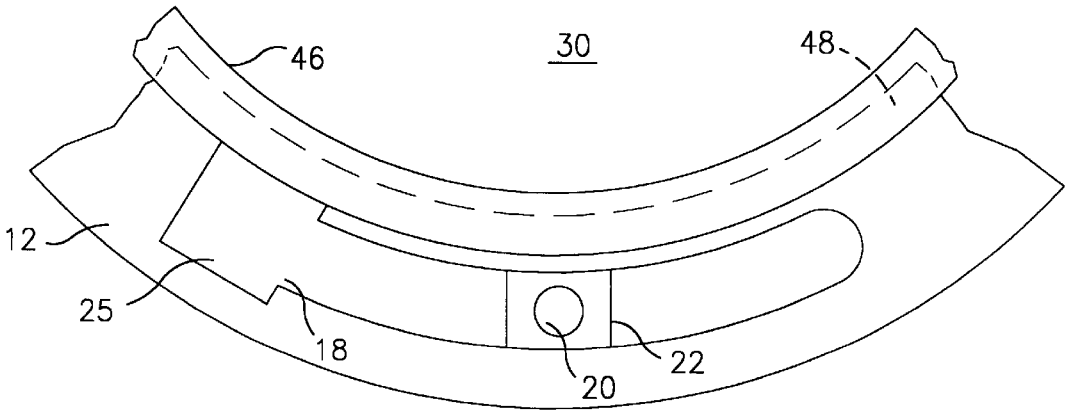
FIG. 4 is a an enlarged partial plan view illustrating the closet flange, flange bolt and seated sealing gasket assembly.

As is shown in FIGS. 3 and 4, closet flange 12 includes two arcuate trough areas 18 for accepting head portions 22 of flange bolts 20 or other similar connecting members well known in the art. Flange bolts 20 are slidingly received within arcuate troughs 18 through expanded trough openings 25 and are slid to a point along arcuate troughs 18 where the flange bolts 20 correspondingly line up with toilet bores 32. Placement of sealing gasket 46 is best shown with reference to FIG. 4, where sealing gasket 46 is positioned along the outer perimeter of closet flange outlet 30 and within inner annular periphery 48 of closet flange 12. Installation of toilet 10 positions toilet outlet 42 within the annular perimeter of sealing gasket 46 to thereby provide a proper fluid seal from toilet outlet 42 to soil pipe 16. Once toilet 10 is installed over closet flange 12, sealing gasket 46 is correspondingly seated within the inner annular periphery 48 of closet flange 12 and the outer annular area 44 of horn portion 34 of toilet 10.

Referring now more particularly to FIGS. 5–8, there is generally provided a toilet installation kit 40 containing all the components necessary for installing or resetting a toilet or water closet 10. The toilet installation kit 40 includes a tray or compartment portion 50 that is generally rectangular in shape although other suitable shapes are also contemplated. In one embodiment, prior to actual use of toilet installation kit 40, the interior of tray 50 is used to house the other components necessary for installing or resetting toilet 10 including connecting assembly 24, sealing gasket 46, mixing or spreading instrument 52 and aggregate 54. In other embodiments, the components associated with toilet installation kit 40 may be packaged separately or combined within any other component associated with toilet installation kit 40.

Figure 6:
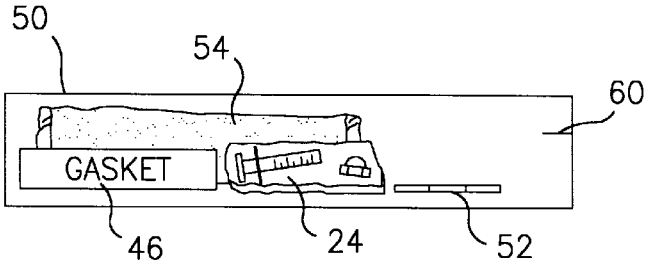
FIG. 6 is an illustrative side view of the toilet installation kit of FIG. 5.

Tray or compartment portion 50 is preferably water proof and sized accordingly to accommodate predetermined amounts of both solution 56 and aggregate 54 which are mixed within tray 50 to form a settling compound 58. The determination of the predetermined amounts of both solution 56 and aggregate 54 vary from factors such as the type of toilet being installed or reset and the particular solution 56 and aggregate 54 being used. Preferably, the present embodiment utilizes water as solution 56 although other similar liquids may be used and plaster as aggregate 54 although other similar aggregates such as grout, mortar, cement and the like may be used. In alternative embodiments, toilet installation kit 40 may include a ready made compound 58 being formed of either plaster, cement, grout, mortar and the like. As is shown in FIGS. 5 and 6, toilet installation kit 40 includes a predetermined measure of aggregate 54 packaged within a plastic bag although other suitable containers are also contemplated. Tray 50 includes indicia representing a fill line 60 for solution 56. Once tray 50 is filled to fill line 60, aggregate 54 is poured or sprinkled within tray 50. Mixing or spreading instrument 52 may then be used to achieve a desired consistency of the solution 56 and aggregate 54 mix to thereby form settling compound 58.

Other components of toilet installation kit 40 include sealing gasket 46 which may be packaged within a protective sleeve, e.g., plastic bag or box. Sealing gasket 46 is preferably made of a paraffin substrate as is well known in the art. In other embodiments, sealing gasket 46 may include other similar sealing members such as rubber or PVC O-rings, tapered sleeves and the like. Connecting assembly 24 includes flange bolts 20 having a head portion 22 and correspondingly sized washers 26 and nuts or nut caps 28. In preferred embodiments, two flange bolts 20 and corresponding assemblies are used to fasten toilet 10 to closet flange 12 although more are contemplated. Connecting assembly 24 is preferably made from corrosion resistant materials such as brass, stainless steel and the like and are preferably included within toilet installation kit 40 packaged within a protective sleeve, e.g., plastic bag or box. Toilet installation kit 40 also includes mixing or spreading instrument 52 used to both mix the aggregate 54 and solution 56 to form compound 58 and to spread or apply the compound 58 to an area on floor 14 outside the perimeter of closet flange 12, as will be described below. The mixing or spreading instrument 52 is preferably a trowel or spatula although any other suitable instrument is contemplated.

It is also contemplated that the toilet installation kit 40 and items contained therein are made to suit standard and typical dimensions and materials common in the toilet and plumbing industries, although specialty sizes and dimensions of any component can be incorporated within toilet installation kit 40.

The toilet installation kit 40 of the present disclosure can be used to install new or reset floor-type toilets 10. The following description is particularly directed to the resetting of a floor-type toilet 10 using the toilet installation kit 40 of the present disclosure although this procedure is also applicable to the installation of a new floor-type toilet 10.

With reference to FIG. 5, a toilet installation kit 40 is provided including tray 50, sealing gasket 46, connecting assembly 24, mixing or spreading instrument 52 and aggregate 54. The toilet 10 to be reset is removed from its fastened position atop closet flange 12. Closet flange 12 is cleaned and prepared in the customary manner discarding any used bolts, washers or nuts. Connecting assembly 24 is removed from the toilet installation kit 40 and a pair of flange bolts 20 are installed within arcuate troughs 18 of closet flange 12, as described earlier. Once installed, flange bolts 20 are perpendicularly positioned with respect to the floor 14 and are aligned with toilet bores 32, as is shown in FIG. 3. Sealing gasket 46 is removed from kit 40 and is seated along inner annular periphery 48 and interiorly spaced between perpendicularly positioned flange bolts 20 to thereby form a sealing ring around closet flange outlet 30.

Figure 7:
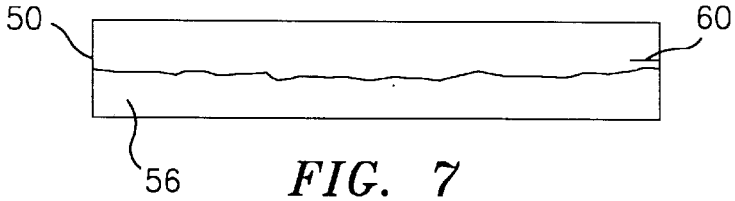
FIG. 7 is an illustrative view of the tray and solution according to the present disclosure.
Figure 8:
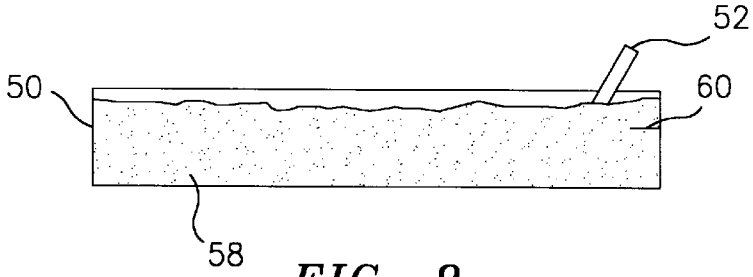
FIG. 8 is an illustrative view of the tray and setting compound according to the present disclosure.

Once preparation of the closet flange 12 and installation of flange bolts 20 are complete, mixing or spreading instrument 52 and aggregate 54 are removed from the tray 50 leaving the interior empty and ready for preparation of compound 58. As shown in FIGS. 7 and 8, an amount of solution 56 is poured into tray 50 until the solution 56 tops off at fill line 60 located on a lateral wall of tray 50. The package containing aggregate 54 is opened and the aggregate is sprinkled or poured into tray 50 to combine with the solution 56 therein. Dependent upon the particular aggregate and solution used, mixing or agitating of the aggregate 54 and solution 56 may be required to form settling compound 58. Mixing is accomplished with the aid of mixing or spreading instrument 52 contained within toilet installation kit 40. Upon preparation of the settling compound 58, the mixing or spreading instrument 52 is used to apply and spread compound 58 onto areas of the floor 14 surrounding the perimeter of closet flange 12. The entire amount of pre-measured settling compound 58 is used in this process in order to achieve rigid securement of toilet 10 to floor surface 14.

With reference to FIGS. 1 and 3, toilet 10 is seated upon closet flange 12 so that flange bolts 20 are received within toilet bores 32. The seating of the toilet 10, displaces the settling compound 58 into recesses 36 and 38 and areas along the inner edge perimeter of horn portion 34. Any excess settling compound 58 is excreted onto floor surface 14 outside the outer edge perimeter of horn portion 34 and removed accordingly. Once the toilet 10 is properly seated, washers 26 are positioned over the flange bolts 20 and corresponding nuts or nut caps 28 are tightened to securely fasten the toilet 10 to the closet flange 12. Any and all other customary connections such as water supply lines are installed to complete the installation of floor-type toilet 10.

It will be understood that various modifications may be made to the embodiments disclosed herein. For example, the toilet installation kit of the present disclosure may also include additional items such as water supply line connections, caulking compounds and other similar plumbing and toilet accessories. Therefore, the above description should not be construed as limiting, but merely as exemplifications of preferred embodiments. Those skilled in the art will envision other modifications within the scope and spirit of the claims appended hereto.

What is claimed is:

1. A toilet installation kit containing pre-measured and disposable toilet installation components, the toilet installation kit including a gasket for sealingly engaging a toilet to a closet flange and a connecting assembly for fastening the toilet to the closet flange, the toilet installation components comprising:

a predetermined measure of aggregate to be mixed with a solution to form a settling compound for stabilizing the toilet to a floor surface;

a tray having an interior for combining the aggregate and solution therein; and a spreading instrument for applying the settling compound to the floor surface.

2. The toilet installation kit according to claim 1, wherein the tray includes indicia indicating a solution fill level.

3. The toilet installation kit according to claim 2, wherein the interior of the tray is sized to accept the gasket, the connecting assembly, the aggregate and the spreading instrument.

4. The toilet installation kit according to claim 1, wherein the connecting assembly includes at least one bolt, washer and nut.

5. The toilet installation kit according to claim 1, wherein the spreading instrument is used for agitating the aggregate and solution to form the settling compound within the interior of the tray.

6. The toilet installation kit according to claim 5, wherein the spreading instrument is a trowel or spatula.

7. The toilet installation kit according to claim 1, wherein the solution is water and the aggregate is selected from the group consisting of: plaster, grout, mortar and cement.

8. A toilet installation kit containing pre-measured and disposable toilet installation components, the toilet installation kit including a gasket for sealingly engaging a toilet to a closet flange and a connecting assembly for fastening the toilet to the closet flange, the toilet installation components comprising:

a predetermined measure of aggregate to be mixed with a corresponding measure of solution to form a settling compound for stabilizing the toilet to a floor surface;

a tray having an interior for combining the pre-determined measure of aggregate and corresponding measure of solution therein, wherein the tray includes indicia indicating the corresponding measure of solution to be combined with the aggregate; and a spreading instrument used for agitating the aggregate and solution to form the settling compound within the interior of the tray and for applying the settling compound to the floor surface.

9. The toilet installation kit according to claim 8, wherein the interior of the tray is sized to accept the gasket, the connecting assembly, the aggregate and the spreading instrument.

10. The toilet installation kit according to claim 8, wherein the connecting assembly includes at least one bolt, washer and nut.

11. The toilet installation kit according to claim 8, wherein the spreading instrument is a trowel or spatula.

12. The toilet installation kit according to claim 8, wherein the solution is water and the aggregate is selected from the group consisting of: plaster, grout, mortar and cement.

13. A method of installing a toilet using a toilet installation kit comprising the steps of:

providing a toilet installation kit including a gasket for sealingly engaging a toilet and a closet flange, a connecting assembly for fastening the toilet to the closet flange, a predetermined measure of aggregate to be mixed with a corresponding measure of solution to form a settling compound for stabilizing the toilet to a floor surface, a tray having an interior for combining the aggregate and solution therein, and a spreading instrument for applying the settling compound to the floor surface;

installing the connecting assembly to the closet flange;

positioning the gasket along the closet flange;

applying the settling compound to the floor surface along an outer perimeter of the closet flange; and positioning the toilet onto the closet flange in alignment with the gasket and connecting assembly.

14. The method of installing a toilet according to claim 13, wherein the tray further includes indicia indicating a solution fill level.

15. The method of installing a toilet according to claim 14, wherein the interior of the tray is sized to accept the gasket, the connecting assembly, the aggregate and the spreading instrument.

16. The method of installing a toilet according to claim 13, wherein the connecting assembly includes at least one bolt, washer and nut.

17. The method of installing a toilet according to claim 13, wherein the spreading instrument is used for agitating the aggregate and solution to form the settling compound within the interior of the tray.

18. The method of installing a toilet according to claim 17, wherein the spreading instrument is a trowel or spatula.

19. The method of installing a toilet according to claim 13, wherein the solution is water and the aggregate is selected from the group consisting of: plaster, grout, mortar and cement.

* * * * *